US005579815A

United States Patent [19]

Labonté

[11] Patent Number: 5,579,815

[45] Date of Patent: Dec. 3, 1996

[54] DRAIN VALVE ASSEMBLY

[76] Inventor: Roger E. Labonté, 110 Crater Crescent, Sudbury, Ontario, Canada, P3E 5Y6

[21] Appl. No.: 385,277

[22] Filed: Feb. 8, 1995

[51] Int. Cl.[6] ..... F16N 31/00; F01M 11/00

[52] U.S. Cl. ..... 141/384; 141/98; 141/346; 251/346; 251/351; 184/1.5

[58] Field of Search ..... 141/98, 346, 382, 141/383, 384; 251/216, 346, 351; 184/1.5; 220/303

[56] References Cited

U.S. PATENT DOCUMENTS

| | | | |
|---|---|---|---|
| 1,039,980 | 10/1912 | Lowe | 141/382 |
| 1,210,707 | 1/1917 | Schweinert | 251/351 |
| 1,463,861 | 8/1923 | Winkley | 141/382 |
| 2,680,546 | 6/1954 | Seaberg | 141/384 |
| 2,985,180 | 5/1961 | Grayson | 251/351 |
| 3,184,091 | 5/1965 | Hoffman | 251/351 X |
| 3,727,638 | 4/1973 | Zaremba, Jr. et al. | 251/346 X |
| 3,871,483 | 3/1975 | Espinosa | 184/1.5 |
| 3,967,697 | 7/1976 | Guenther | 184/1.5 |
| 4,101,000 | 7/1978 | Scully | 184/1.5 |
| 4,530,421 | 7/1985 | Balch | 184/1.5 |
| 4,776,430 | 10/1988 | Rule | 184/1.5 |
| 4,807,847 | 2/1989 | Martz | 251/351 X |
| 4,815,566 | 3/1989 | Caruso | 184/1.5 |
| 4,860,805 | 8/1989 | Townsend | 141/382 |
| 4,977,978 | 12/1990 | Batrice | 184/1.5 |
| 4,993,517 | 2/1991 | Leipelt | 184/105.1 |
| 5,107,808 | 4/1992 | Mahn et al. | 184/1.5 X |
| 5,127,118 | 7/1992 | Johenning | 141/382 X |
| 5,386,881 | 2/1995 | Eshelman | 184/1.5 |

FOREIGN PATENT DOCUMENTS

| | | |
|---|---|---|
| 240813 | 7/1924 | Canada . |
| 2070201 | 1/1993 | Canada . |

*Primary Examiner*—J. Casimer Jacyna

[57] ABSTRACT

A drain valve assembly for draining fluid from a container, for example an engine crankcase, is constructed with a first threaded bolt portion having external threads for engaging in a threaded drain outlet of the container and internal threads in an axial passage passing through the first threaded bolt portion, a second threaded bolt portion having external and internal threads whereby, use, the external threads engage in the internal threads of the first threaded bolt portion to seal therewith and whereby passages extend through the first and second bolt portions to permit flow of fluid therethrough. A sealing member forms part of the second threaded bolt portion whereby on full insertion of the second threaded bolt portion in a first position within the first threaded bolt portion, the sealing member engages an adjacent surface to prevent the escape of fluid from the container and, on retraction to a second position, the flow of fluid through the first and second threaded bolt portions is permitted. The second threaded bolt portion has a passage therethrough which is of a first cross-sectional area opening into a passage of a second larger cross-sectional area terminating at the sealing member and having a side wall with at least one aperture therethrough for the flow of fluid between the passage in the first threaded bolt portion and the passage in the second threaded bolt portion.

7 Claims, 2 Drawing Sheets

DRAIN VALVE ASSEMBLY

FIELD OF THE INVENTION

This invention relates to a drain valve assembly for draining fluid from a container and particularly to an improved oil drain valve assembly which is used to drain oil from an engine crankcase of an internal combustion engine as are encountered on lawn mowers, garden tractors, snow blowers, heavy equipment, cars, trucks, stationary engines.

DESCRIPTION OF PRIOR ART

To change the crankcase oil in internal combustion engines it is usual to have to unscrew a threaded male plug received within the crankcase opening located on the side or underside of the crankcase, to drain the oil, and screw the plug back into the opening before refilling the crankcase with clean new oil. This is a messy and inconvenient procedure and often results in oil leaking which can be messy and present an environmental hazard.

OBJECT OF THE INVENTION

It is an object of this invention to provide a drain valve assembly Which is simple in design and operation which, when used for draining engine oil, can be operated by an unskilled person and which is not so inconvenient and messy to use as the above-mentioned prior art plug so as to reduce oil leaks and spills.

SUMMARY OF THE INVENTION

According to the present invention there is provided a drain valve assembly for draining fluid from a container comprising a first threaded bolt portion having external threads for engaging in a threaded drain outlet of said container and internal threads in an axial passage passing through said first threaded bolt portion, a second threaded bolt portion having external and internal threads whereby, in use, the external threads engage in the internal threads of said first threaded bolt portion to seal therewith and whereby passages extend through said first and second bolt portions to permit flow of fluid therethrough, a sealing member forming part of said second threaded bolt portion whereby on full insertion of said second threaded bolt portion in a first position within said first threaded bolt portion, said sealing member engages an adjacent surface to prevent the escape of fluid from said container and, on retraction to a second position, the flow of fluid through said first and second threaded bolt portions is permitted, said second threaded bolt portion having a passage therethrough which is of a first cross-sectional area opening into a passage of a second larger cross-sectional area terminating at said sealing member and having a side wall with at least one aperture therethrough for the flow of said fluid between the passage in said first threaded bolt portion and the passage in said second threaded bolt portion.

BRIEF DESCRIPTION OF THE DRAWINGS

An embodiment of the present invention will now be described, by way of example, with reference to the accompanying drawings with like reference numerals being applied to corresponding parts throughout and in which.

DESCRIPTION OF THE PREFERRED EMBODIMENT

Figure 1:
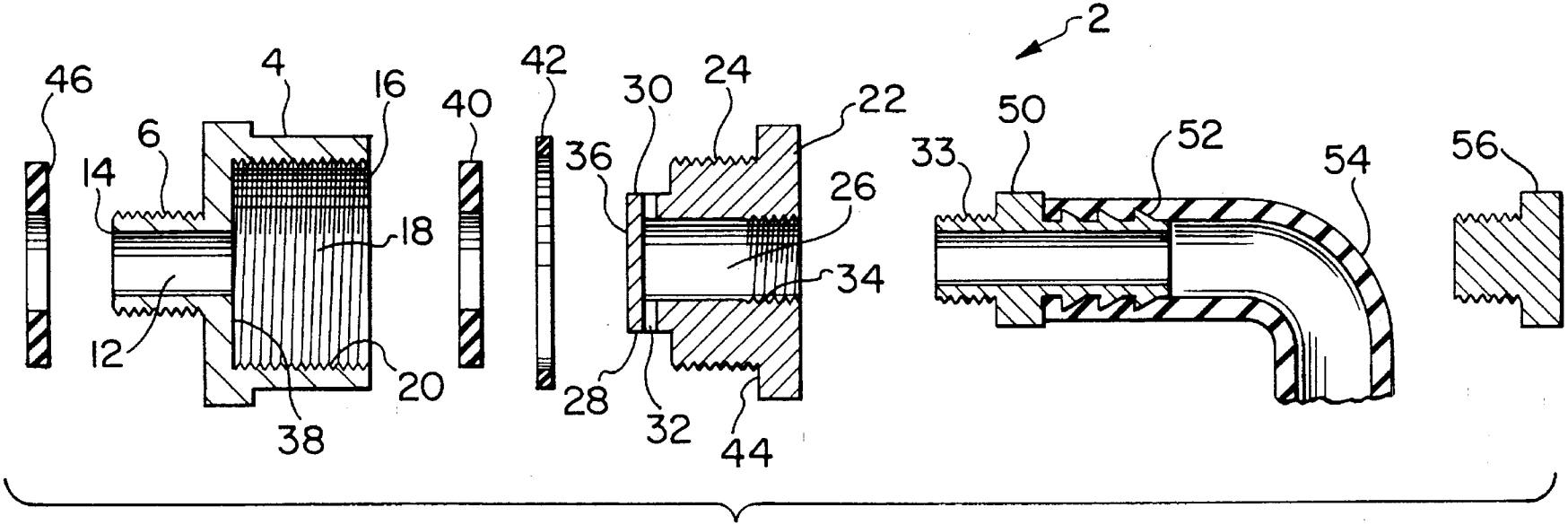
FIG. 1 is an exploded, cross-sectional view of an oil drain valve assembly, constructed in accordance with the principles of the present invention.
Figure 2:
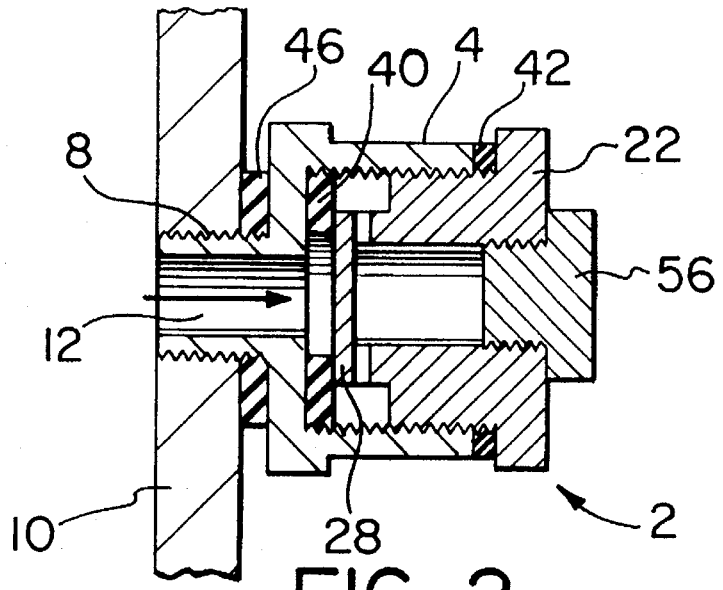
FIG. 2 is a cross-sectional view of the oil drain valve assembly of FIG. 1 after assembly and in the closed or sealed position.
Figure 3:
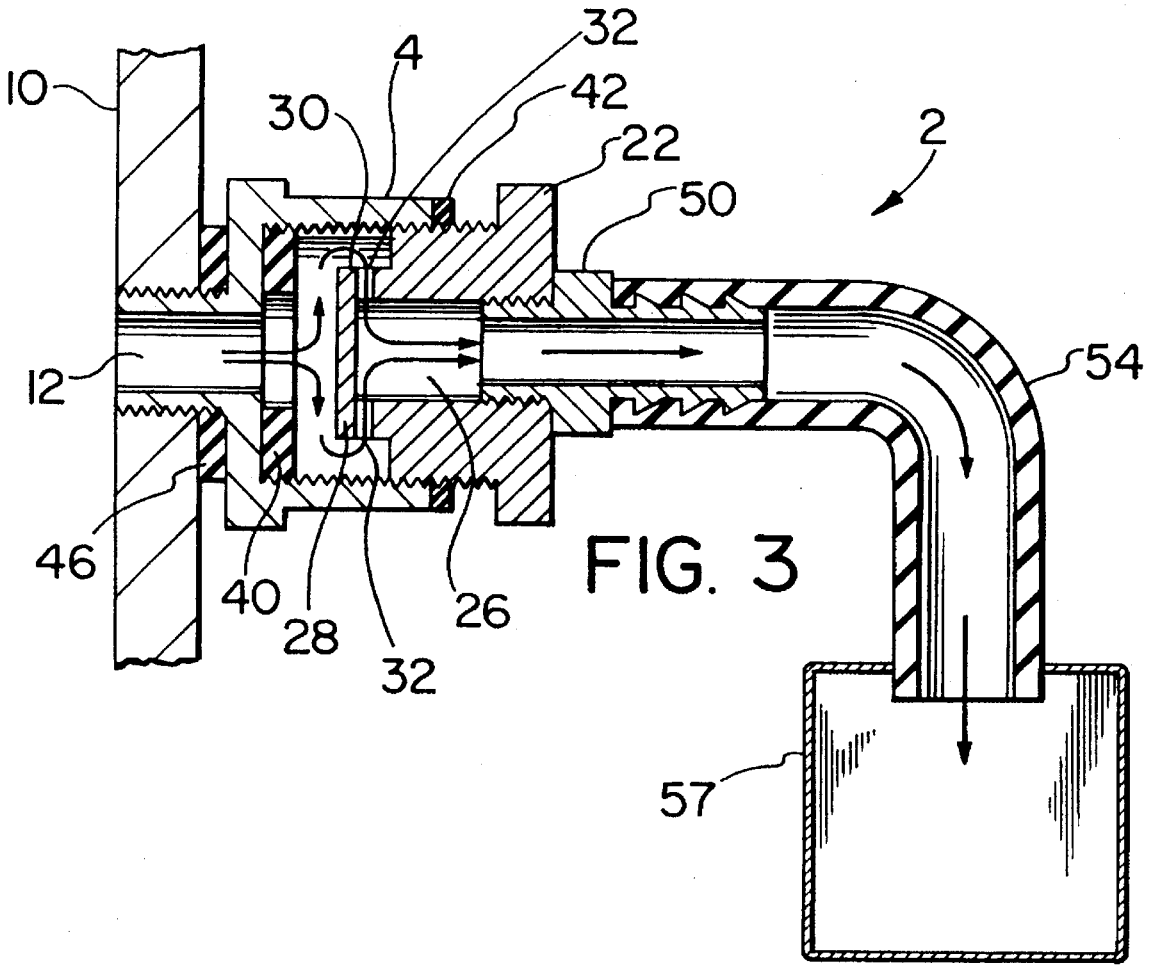
FIG. 3 is a cross-sectional view of the oil drain valve assembly of FIG. 1 in the opened or draining position.

Referring now in detail to the drawings, there is shown in FIGS. 1–3 an oil drain assembly 2 which comprises a first threaded bolt portion 4 having an externally threaded male member 6 which is capable of being received in an internally threaded opening 8 (FIGS. 2 and 3) in the wall of an engine oil container such as a crankcase 10 of an internal combustion engine. The member 6 may be made of a non-corrosive metallic material, such as zinc or zinc alloy.

As can be seen in the figures, the bolt portion 4 has an axial oil passage or bore 12 through its entire length between the end 14 of member 6 and the opposite end 16. Between the ends 14 and 16 and towards end 16 the axial oil passage 12 opens into a larger cavity 18 as can be seen more clearly in FIG. 1. The cavity 18 is provided with internal threads 20.

A second threaded bolt portion 22 forms part of the oil drain assembly 2 and is provided with external threads 24 whereby, in use, threads 24 engage with threads 20 as the second threaded bolt portion 22 engages with the first threaded bolt portion 4 as shown in FIGS. 2 and 3.

An axial oil passage 26 is provided in the second bolt portion 22 and terminates at sealing member 28. The side wall, or walls, 30 of the second cross-sectional area are provided with one or more apertures 32 for the flow of oil therethrough. The outer end of passage 26 is provided with an internally threaded portion 34.

When the second bolt portion 22 is threadedly inserted fully in cavity 18 of the first threaded bolt portion 4, the external surface 36 of sealing member 28 engages with internal adjacent surface 38 of the first bolt portion 22 to form a seal therewith to prevent oil passing out of the smaller portion of the axial passage 12 into the larger cavity 18. For greater sealing effect a doughnut or O-shaped gasket member 40 may be used between sealing member 36 and surface 38 whereby the sealing member actually engages an adjacent surface of gasket member 40. Additionally a lock washer member 42 is shown for use between the surface 44 of the outer flange portion of the second bolt portion 22 and the corresponding external surface of the first bolt portion 4 widen in the closed position as shown in FIG. 2. A further gasket member 46 is shown for use between the first threaded bolt portion 4 and the crankcase 10.

When fluid, e.g. oil, is to be extracted from a fluid reservoir such as an engine oil reservoir 10 (FIG. 2) a threaded fitting 50 (FIG. 1) is used having at one end threads 33 for engaging with threads 34 of the second bolt portion 22 and at the other end a hose pipe receiving portion 52, a lose pipe 54 being diagrammatically shown thereon. The first and second threaded bolt portion is 4 and 22 have, of course, to be in the opened or draining position.

When use of the drain valve assembly is completed and the assembly is returned to its closed or sealed position, a threaded plug member 56 (FIG. 1) can be used to engage with threads 34 and close the end of the axial passage 26 and prevent the entry of dust or other contaminants.

As will be seen from FIG. 2 when the oil drain valve assembly is in the closed or sealed position the first threaded body portion 4 is screwed tightly into the drain hole of crankcase 10, leakage of oil being prevented due to the cooperation between the gasket 46 and the opposing surfaces of the first threaded bolt portion 4 and the crankcase 10.

The second threaded bolt portion 22 is screwed tightly into the axial passageway of the first threaded bolt portion 4, sealing member pressing against gasket 40 to prevent oil from passing out of the axial oil passage 12. Lock washer 42 is effective to lock the two threaded bolt portions together, whilst plug 56 closes the end of the passage as described above.

When it is necessary to drain oil from the crankcase 10, plug 56 is removed and the threaded fitting 50 has one end inserted sealingly into the axial passage of the second threaded bolt portion 22. A hose pipe 54 has one end attached over appropriate enlargements of the threaded fitting 50 and its end passes into the interior of an oil recycling container 57 (FIG. 3).

FIG. 3 shows the oil drain assembly in an opened or draining position. The threaded fitting 50 is inserted sealingly into the axial passageway of the second threaded bolt portion 22 with hose pipe 54 in position for draining oil into the oil recycling container 57. The second threaded bolt portion 22 is unscrewed from the first threaded bolt portion 4 whereby sealing member 28 is withdrawn so as to be spaced from the gasket 40. Oil then drains out of crankcase 10 through axial oil passage 12, transversely around the sealing member 28, and through the aperture or apertures 32 in the side wall, or walls, 30. It then drains axially through passage 26 into hose pipe 54 and into oil recycling container 57.

After use, the second threaded bolt portion 22 is screwed into the first threaded bolt portion 4 so that the sealing member 28 stops the flow of oil from the axial passage 12.

Threaded fitting 50 is removed from the second threaded bolt portion 22 and replaced by the plug 50.

The dimensions of the oil drain assembly will depend on its use but typical values are with an outside longitudinal dimension of about 1½ to 2 inches, a width of about 1 inch, and the bore in the crankcase and the diameter of plug 56 where it enters the second threaded bolt portion 22 being about ½ inch.

From the foregoing detailed description, it will be seen that the described embodiment of the invention provides an improved oil drain valve assembly which is simple in design and operation for draining oil from a combustion engine requiring basic hand tools and minimal physical effort. It is adaptable to existing engines and without any need for alterations in design or performance.

While there has been illustrated and described what is at present considered to be a preferred embodiment of the present invention, it will be understood by those skilled in the art that various changes and modifications may be made and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An oil valve assembly for draining oil from an engine crankcase comprising:

(a) a first threaded bolt portion having first external threads for engaging in a threaded drain outlet of said engine crankcase and first internal threads in a first axial passage passing through said first threaded bolt portion, said first axial passage having a substantially planar annular sealing surface, (b) a second threaded bolt portion having second external threads and second internal threads whereby, in use, said second external threads of said second threaded bolt portion engage said first internal threads of said first threaded bolt portion to seal therewith, said second threaded bolt portion having an integral sealing member with a substantially planar surface, a second axial passage terminating at said sealing member and extending substantially orthogonal thereto, and at least one aperture in fluid communication with said axial passage and said first axial passage, whereby on full insertion of said second threaded bolt portion in a first position within said first threaded bolt portion, said sealing member engages said annular sealing surface of said first threaded bolt portion to prevent the escape of oil from said engine crankcase and, on retraction to a second position, the flow of oil through said first and second threaded bolt portions is permitted.

2. A valve assembly according to claim 2 further comprising:

(c) a gasket member located between said annular sealing surface and said sealing member such that said sealing member engages said sealing surface via said gasket member.

3. A valve assembly according to claim 2 including a threaded plug member inserted to engage with said second internal threads in an outermost end of said second axial passage of said second threaded bolt portion to close said outermost end.

4. A valve assembly according to claim 2 including a threaded fitting having one end engaging with said second internal threads in an outermost end of said second axial passage of said second threaded bolt member, and a hose pipe engaging with the other end of said threaded fitting for drainage purposes.

5. A valve assembly according to claim 1 including a threaded plug member inserted to engage with said second internal threads in an outermost end of said second axial passage of said second threaded bolt portion to close said outermost end.

6. A valve assembly according to claim 1 including a threaded fitting having one end engaging with said second internal threads in an outermost end of said second axial passage of said second threaded bolt member, and a hose pipe engaging with the other end of said threaded fitting for drainage purposes.

7. A valve assembly according to claim 1 wherein said at least one aperture is a substantially radial throughbore.

* * * * *